US005323625A

United States Patent [19]

Paggiaro

[11] Patent Number: 5,323,625

[45] Date of Patent: Jun. 28, 1994

[54] ELECTRONIC FEEDER APPARATUS FOR AUTOMATICALLY CONTROLLING THE TENSION OF THE YARN IN A KNITTING MACHINE AND TEXTILE MACHINES IN GENERAL

[76] Inventor: Angelo Paggiaro, Via Predisera, 56, 21013 - Gallarate (Varese), Italy

[21] Appl. No.: 33,184

[22] Filed: Mar. 16, 1993

[30] Foreign Application Priority Data

Mar. 17, 1992 [IT] Italy ..... MI92 A 000621

[51] Int. Cl.[5] ..... D04B 15/44

[52] U.S. Cl. ..... 66/146; 66/163; 242/37 R

[58] Field of Search ..... 66/146, 158, 160, 161, 66/163, 164; 28/186, 187; 57/80, 81; 226/10, 195, 29; 242/37, 49, 147; 139/349, 353; 200/61.13, 61.18

[56] References Cited

U.S. PATENT DOCUMENTS

| | | | |
|---|---|---|---|
| 3,807,199 | 4/1974 | Rosen | 66/163 |
| 4,016,732 | 4/1977 | Merkle | 66/163 |
| 4,194,375 | 3/1980 | Marchisio | 66/146 X |
| 4,455,549 | 6/1984 | Rydborn | 242/37 R X |
| 4,628,710 | 12/1986 | Jacobsson | 66/163 X |
| 4,744,227 | 5/1988 | Whitener, Jr. et al. | 66/163 |
| 4,752,044 | 6/1988 | Memminger et al. | 66/146 X |
| 4,829,790 | 5/1989 | Memminger et al. | 66/146 X |
| 5,136,499 | 8/1992 | Rydborn | 66/163 X |

FOREIGN PATENT DOCUMENTS

| | | | |
|---|---|---|---|
| 2586716 | 3/1987 | France | 66/163 |

*Primary Examiner*—Clifford D. Crowder
*Assistant Examiner*—John J. Calvert
*Attorney, Agent, or Firm*—Bucknam and Archer

[57] ABSTRACT

A feeder apparatus for automatically controlling in real time the tension of a textile yarn, includes a control device for continuously controlling the tension of the textile yarn, before supplying it to a textile machine, the control device controlling a swinging lever arranged downstream of a drum and driving an adjustable movable shield element adapted to intercept a light, thermal or electromagnetic radiation impinging on a sensor which transforms the received radiation into an electronic signal proportional to said radiation and driving a display of the yarn tension.

12 Claims, 5 Drawing Sheets

ELECTRONIC FEEDER APPARATUS FOR AUTOMATICALLY CONTROLLING THE TENSION OF THE YARN IN A KNITTING MACHINE AND TEXTILE MACHINES IN GENERAL

BACKGROUND OF THE INVENTION

The present invention relates to an improved feeder apparatus for automatically controlling the tension of a yarn, including an electronic device for detecting possible faults, which can be applied to machines for making fabrics, knitted fabrics and cloth articles, and to textile machines in general.

As is known, in knitting machines and other textile machines there are usually provided several yarn feeders which conventionally comprise two small levers, articulated at different articulation points, which cooperate with corresponding switches.

These switches are independent from one another and and are adapted to disenergize the machine as a yarn is broken, by signalling a possible breakage of the yarn by means of individual light displays.

Also known is that conventional circular knitting machines are supplied with a lot of yarns, the tension of which must be controlled immediately upstream of the yarn inlet to the machine for a proper operation of the latter.

This control is at present performed manually, yarn by yarn, by using mechanical or electronic tension measuring devices, which must be held in a hand of the operator, whereas the operator by his other hand, adjusts the knitted fabric.

Moreover, in prior knitting machines, the operator controlling possible faults of the yarn feeders, must walk about the machine, which may have a diameter up to 2.5 metres, in order to detect the yarn feeder the yarn of which is broken.

This, as it should be apparent, requires a lot of time with a consequent decrease of the textile machine yield.

Moreover, the delays in recovering the proper operation of the machine are further increased by the fact that the individual displays, provided for displaying the yarn breakages, are frequently scarcely visible because of powder and the like, and because of the high lighting usually provided in the textile machine room.

Thus, the operation the textile machine is frequently stopped, with a consequent loss of time by the operator, even if the machine ne is not in a fault condition.

This drawback occurs because possible small impacts, or increases of the tension of the yarns, of very short duration, due, for example, to a badly wound bobbin or between the end of a bobbin and the start of a subsequent bobbin, or, moreover because of dirt accumulating between the yarn braking discs.

Accordingly, the above mentioned temporary variations of the tension of the yarns, cause the related movable mechanical lever to vibrate and the textile machine to stop since the lever undesirably impacts against the corresponding switch.

SUMMARY OF THE INVENTION

Accordingly, the aim of the present invention is to overcome the problems and drawbacks thereinabove mentioned, by providing an improved feeder apparatus which allows a continuous control of the tension of the yarn before supplying said yarn to the textile machine, and which, moreover, comprises an electronic display device for displaying and controlling, in a centralized way, possible faults, which electronic device also includes auto-diagnosis means allowing an operator to easily and quickly repair a feeder which has been detected in a fault condition.

Within the scope of the above mentioned aim, a main object of the present invention is to provide such an improved feeder which is so designed as to greatly facilitate the job of the operator, to provide optimum conditions from the yield standpoint.

Another object of the present invention is to provide such a yarn feeder for textile machines which can feed its yarn without being negatively affected by dirt and the like.

Yet another object of the present invention to provide a yarn feeder which is very reliable and safe in operation and, moreover, is very competitive from a mere economic standpoint.

According to one aspect of the present invention, the above mentioned aim and objects, as well as yet other objects, which will become more apparent hereinafter, are achieved by an improved feeder apparatus for automatically controlling in real time the tension of a textile yarn, said feeder apparatus including an electronic multiple function device, and being provided for application to knitting machines and textile machines in general, characterized in that said feeder apparatus comprises a device applied to a lever for continuously controlling the tension of the yarn, before the inlet of said yarn into said textile machine, and a device for displaying and controlling possible faults of said feeder apparatus, said lever being a swinging lever arranged downstream of a drum and operating for controlling the position of an adjustable movable shield element adapted to intercept light, thermal or electromagnetic radiations; said shield being arranged between a radiation emitting element and a radiation sensing element, in order to chop the amount of radiations received by the sensor which transforms the received radiation amount to an electronic signal proportional to said radiation amount, said signal, which can be suitably amplified, controlling, depending on its amplitude, a display of the yarn tension, depending also on the swinging amplitude of said lever.

BRIEF DESCRIPTION OF THE DRAWINGS

Further characteristics and advantages of the yarn feeder apparatus according to the present invention will become more apparent hereinafter from the following detailed disclosure of a preferred, though not exclusive, embodiment thereof, which is illustrated, by way of an indicative, but not limitative example, in the figures of the accompanying drawings, where.

DESCRIPTION OF THE PREFERRED EMBODIMENTS

Figure 1:
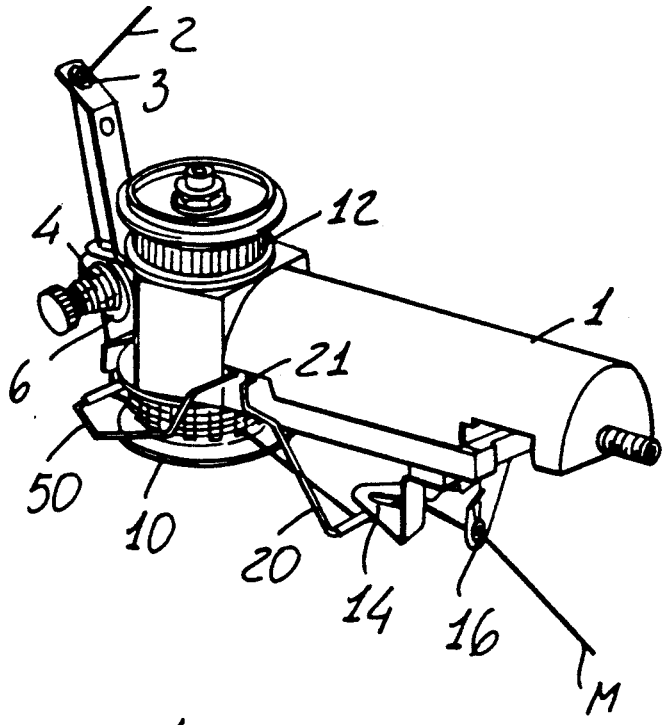
FIG. 1 is a perspective view of the improved yarn feeder apparatus, for automatically controlling the tension of the yarn, and including a multiple function electronic device for performing a centralized display and control of possible faults, according to the present invention.
Figure 2:
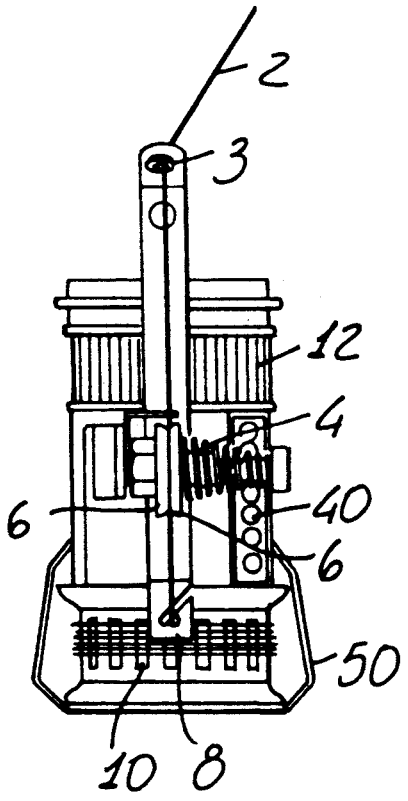
FIG. 2 is a front view of that same improved feeder apparatus shown in FIG. 1.
Figure 3:
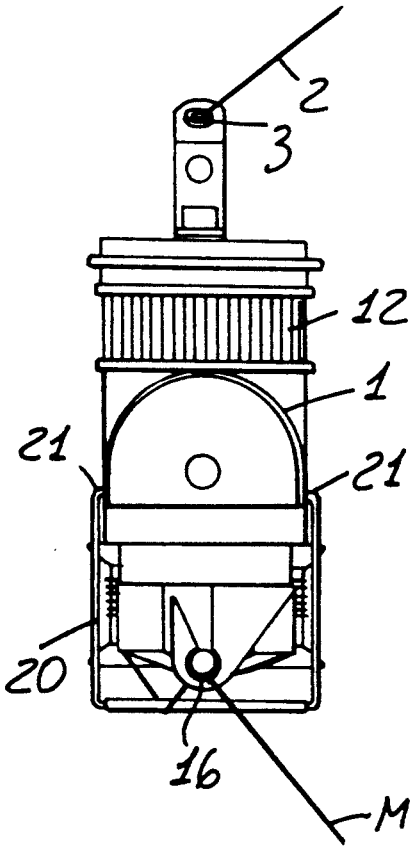
FIG. 3 is a rear view of the improved feeder apparatus shown in FIG. 1.

With reference to the number references of the figures of the accompanying drawings, the improved feeder apparatus according to the present invention, which has been generally indicated at the reference number 1, comprises a device for continuously controlling the tension of a yarn to be supplied to a textile machine, and an electronic device for displaying and controlling, in a centralized manner, possible faults occurring in said feeder.

Each textile machine will be provided with a plurality of these feeder apparatus.

In this feeder, the yarn 2, supplied by a yarn supply R (not shown) is guided by a first transmission bush element 3, so as to pass through a brake 4 comprising two opposite discs 6, the clamping of which can be adjusted in a known way.

Before deviation by an eye element 8, the yarn will engage a first lever lever 50, adapted to operate in the case of a breakage of the yarn; then, this yarn will be wound in several turns about a drum 10 including a plurality of slots.

This drum is rotatively driven through pulley 12, coaxially rigid with the drum and driven by a toothed belt.

Before supplying to the textile machine M, the yarn 2 passes through a further eye element 14 and on a second bush element 16.

Between these two passages, the yarn rests on the second movable lever 20, responsive to the tension of the yarn, and articulated on the housing 1 at a transversal axis 21.

Figure 4:
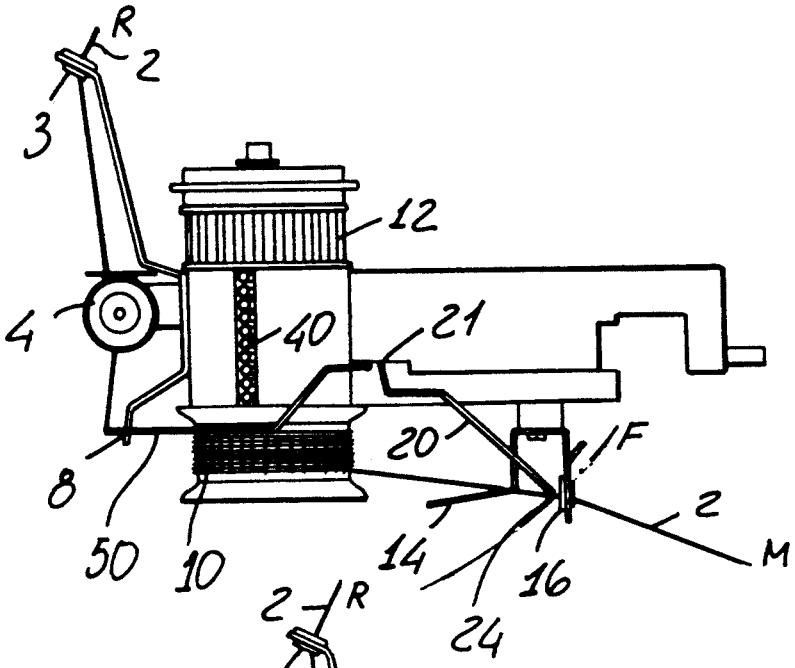
FIG. 4 i s a side view of the subject feeder apparatus, in a working condition thereof, with the yarn under tension.

As is clearly shown in FIG. 4, the lever 20 is provided with a cross-piece 24, bearing on the yarn 2.

This lever 20 i s urged to move in the direction of the arrow F, under the action of a suitable counterweight element, or a blade spring, as it will be disclosed in a more detailed way hereinafter.

Figure 5:
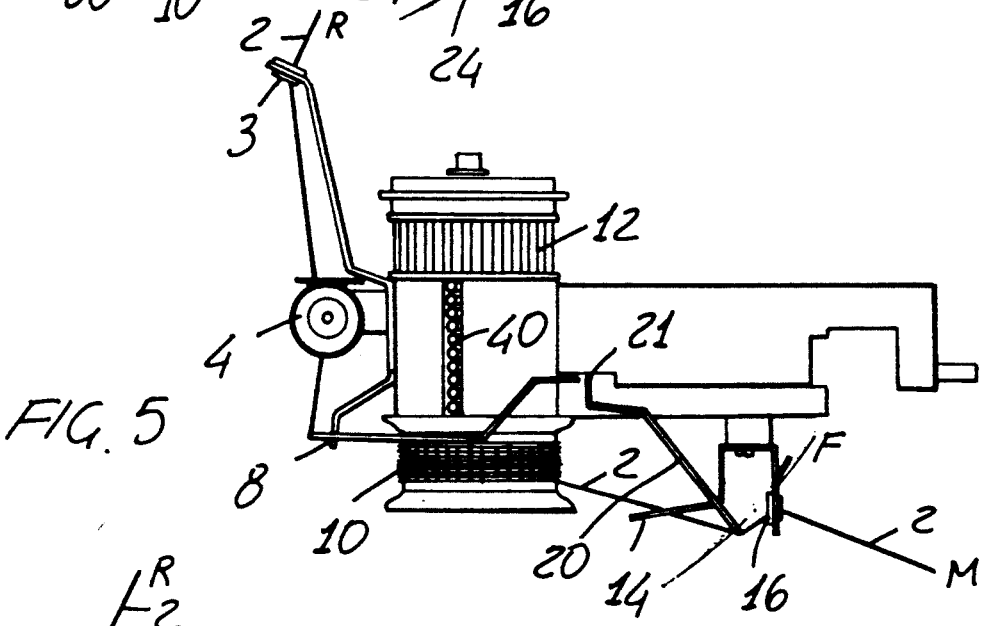
FIG. 5 is another side view of the improved feeder apparatus, in a working condition thereof, with the yarn free of tension.

FIG. 5 shows the position of the lever 20 in a normal tension condition of the yarn which follows a broken line.

If the yarn is greatly tensioned, as it is shown in FIG. 4, then the path assumed by said yarn, between the bush element 16 and drum 10, will be substantially rectilinear, since the lever 20 is urged to upwardly raise.

Figure 6:
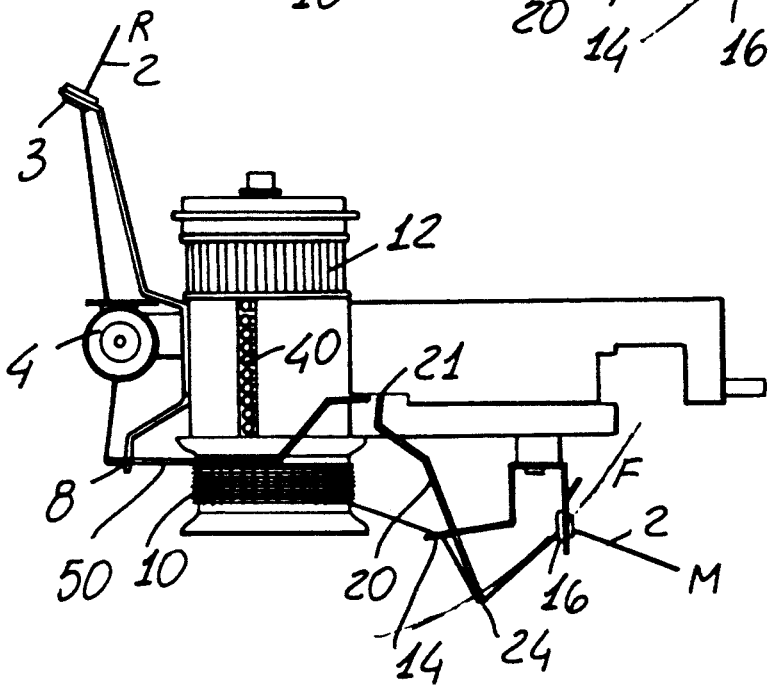
FIG. 6 is a further side view of the improved feeder apparatus, with the yarn in a loose condition.

On the contrary, if the tension on the yarn is small, then the lever 20 will be arranged in a substantially vertical position, by causing the yarn 2 to assume the configuration shown in FIG. 6.

Figure 12:
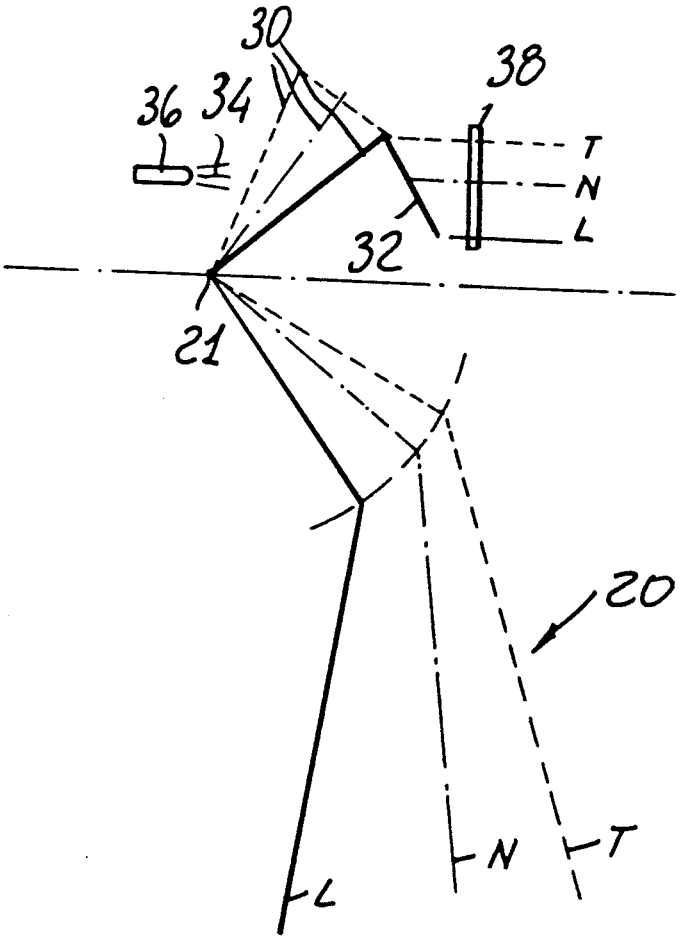
FIG. 12 i s a schematic view, on an enlarged scale, illustrating the principle thereon based the device for continuously controlling the tension of the yarn.

The principle on which the yarn tension controlling device according to the invention is based is schematically shown in FIG. 12.

In this Figure there are shown, on an enlarged scale, two end positions L and T of the lever 20, which substantially correspond to FIGS. 6 and 4, and respectively related to the loose condition of the yarn and to the very tensioned condition thereof, as well as any intermediate positions N represented by a dashed line, corresponding, for example, to a normally tensioned condition of the yarn (see FIG. 4).

At the articulation point 21, as an extension of the arm of the lever 20, there is provided an arm 30, rigid with said lever, to which there is applied, according to the above mentioned device, a shield, indicated at the reference number 32, either of the fixed or of the adjustable type, adapted to shut off a flow 34 of any suitable type of radiation, for example light, magnetic or thermal radiations, as emitted by an emitter 36 and directed to a radiation sensor 38.

As shown in FIG. 12, at the position L of the lever 20 (as indicated by the continuous line), the shield 32 will fully shut-off the radiation beam 34 directed toward the sensor 38; in the normal position N (as indicated by the dashed line), the shutoff is partial , whereas in the position T (see the line constituted by the small dashes) the shut-off is zero.

To these shut-off conditions, correspond related different values of the electric voltage generated by the sensor 38.

Figure 11:
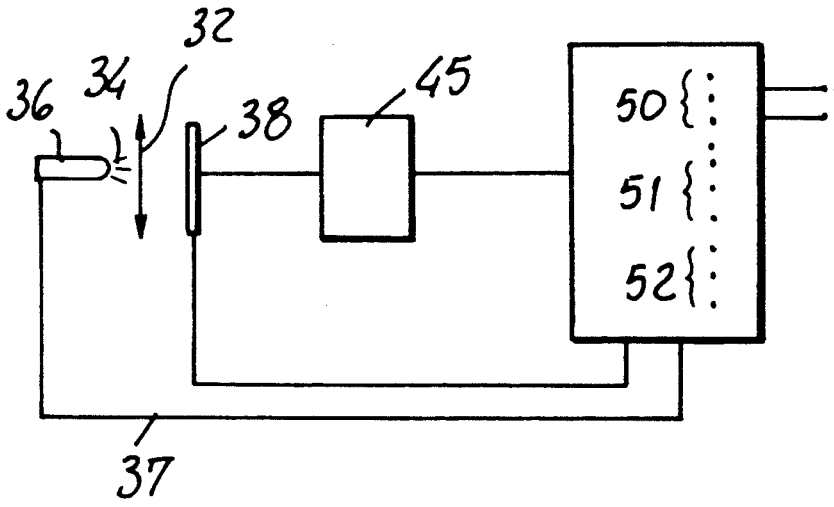
FIG. 11 illustrates and electric diagram of the device for continuously controlling the tension of the yarn, before supplying said yarn to the textile machine.

The electric diagram of the first device thereinabove disclosed is shown in FIG. 11.

In this figure, the emitter element 36, supplied by a line 37, will irradiate toward the receiving sensor 38, a flow 34 of radiations which are variably shut-off or intercepted by the shield 32 connected to the arm 30 of the lever 20, depending on the position of the latter.

The voltage available at the output of the sensor 38 will be suitably amplified, if necessary, by an amplifier 45 in order to turn-on a plurality of diode assemblies 50, 51, 52 of different colours, preferably red, green and yellow, in order to signal in a differentiated way, the related strictly dependant degree of tension of the yarn, as shown above, which will depend on the angular position of the lever 20.

More specifically, under a normal tension condition of the yarn, the green LED' s wi 11 be energized, whereas in a great tension condition of the yarn the red LED's will be energized, and in a loose condition of the yarn the yellow LED's will be energized.

The diodes 50, 51 and 52 are assembled on a diode card 40, arranged at any suitable position in the housing of the yarn feeder, or are inserted in said card, as shown in FIG. 4.

Figure 7:
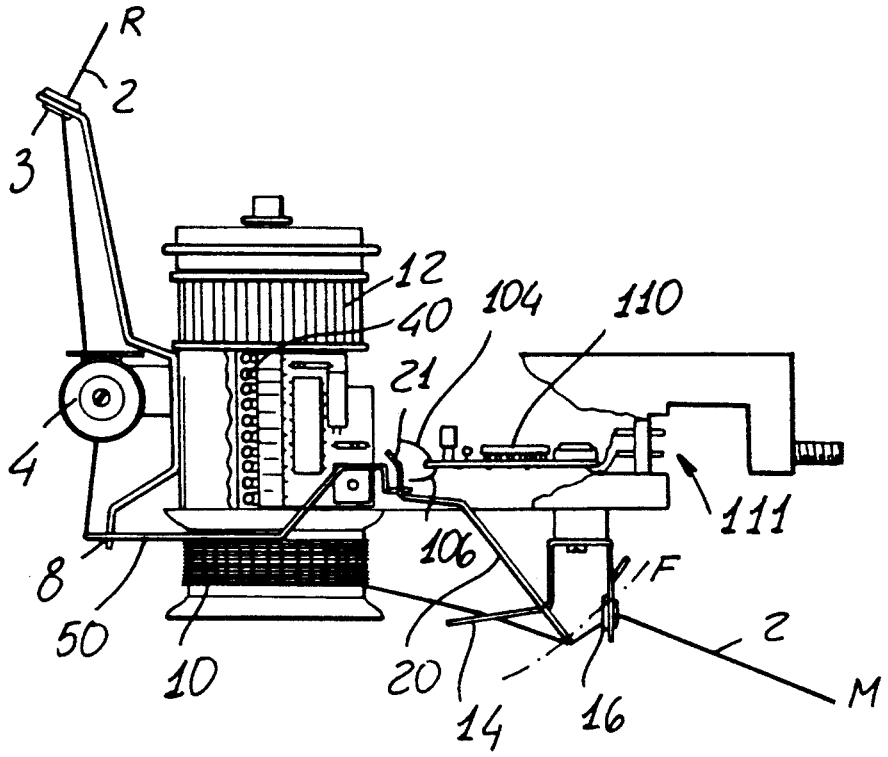
FIG. 7 is a schematic view of the improved feeder apparatus according to the present invention, in which there is clearly shown a coding card and a further electronic card controlling the tension of the yarn.

The above disclosed electronic device for displaying and controlling in a centralized way possible faults of the yarn feeders, according to the present invention, is provided with a very important feature, i.e. that the switches, indicated at the reference numbers 104 and 106 in FIG. 7, and integrated with the above mentioned levers, are operatively connected to a coding card, generally indicated at the reference number 110.

The latter is connected in parallel to an electric line, overally indicated at the reference number 111, which is of the two-wire type and is connected to a central control card, generally indicated at the reference number 120.

Figure 8:
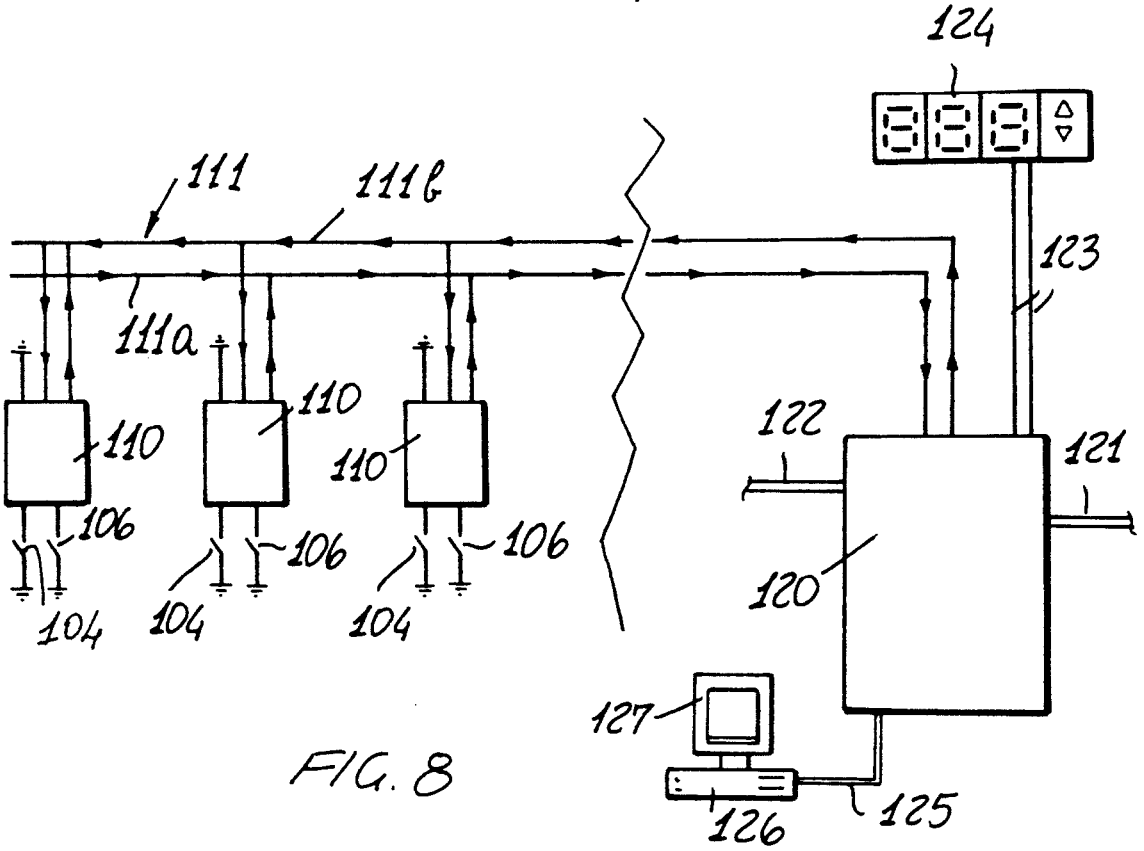
FIG. 8 is an electric connection diagram showing the electric connections of the several coding electronic cards connected to the individual yarn feeders, in a knitting machine, and a central control card or board, of the subject electronic device for performing centralized display and control operations of faults, also according to the present invention.

On the line 111 there are parallel connected all the cards 110 which correspond to the dividual yarn feeders (see FIG. 8).

More specifically, the line 111 comprises a wire 111 *a* which carries the supply current for the cards 110, and a second wire 111*b*, which carries the signals processed by the several cards 110, both said wires being connected to the control card 120.

Moreover, the individual cards 110 are individually connected to ground.

The central control card 120, in turn, is power supplied through the line 121 and includes an output line 122 in order to stop the operation of the textile machine ne.

Moreover, the cards 120 drive, through a line 123, a display 124 adapted to display, by means of a digital type of display, the yarn feeder which is under a fault condition.

Moreover, at the output of the card 120 there is moreover provided an auxiliary line 125, which is interconnected to an interface 126 for driving a processor 127.

With the disclosed arrangement, the central displaying is performed by introducing, into each yarn feeder, a coding electronic card 110, each of which is responsive to the switching state of the switches 104 and 106 which will signal, through the operation of the levers 20 and 50, the good condition of the yarn or the tension condition thereof.

The control card is so programmed as to make visible, on the display 124, preferably of the three digit type, the number of the switched on or off switch, as well as their locations, for example high for the breakage of the yarn supplied to the accumulating drum and low for a breakage of the yarn at the output of said drum.

Each codifying or coding electronic card is supplied from the first of the two connecting lines with return to ground.

The first line of wire 111*a* receives and transmits to the central control card the signals of each individual codifying or coding card, as it has been already disclosed.

The control card verifies, sequentially, the conditions of the coding cards, connected to the switches related to the individual yarn feeders.

As a fault occurs, the central control card will display the distinctive number of the first switch, the condition of which has switched, and, simultaneously, it will stop the textile machine, so as to allow the operator to recover the good operation conditions.

Only upon actuating a reset function by the operator, said control card will continue to cyclically and sequentially diagnose another possible malfunction or fault, susceptible to occur at a subsequent position.

In this connection it should be pointed out that the above mentioned reset operation can also be performed automatically, as the operator resets the lever which has been brought to a lowered position.

Under such an event, the control card will continue its search of a possible fault and, if not, then the display will remain in an off condition until another subsequent malfunction is detected.

Figure 10:
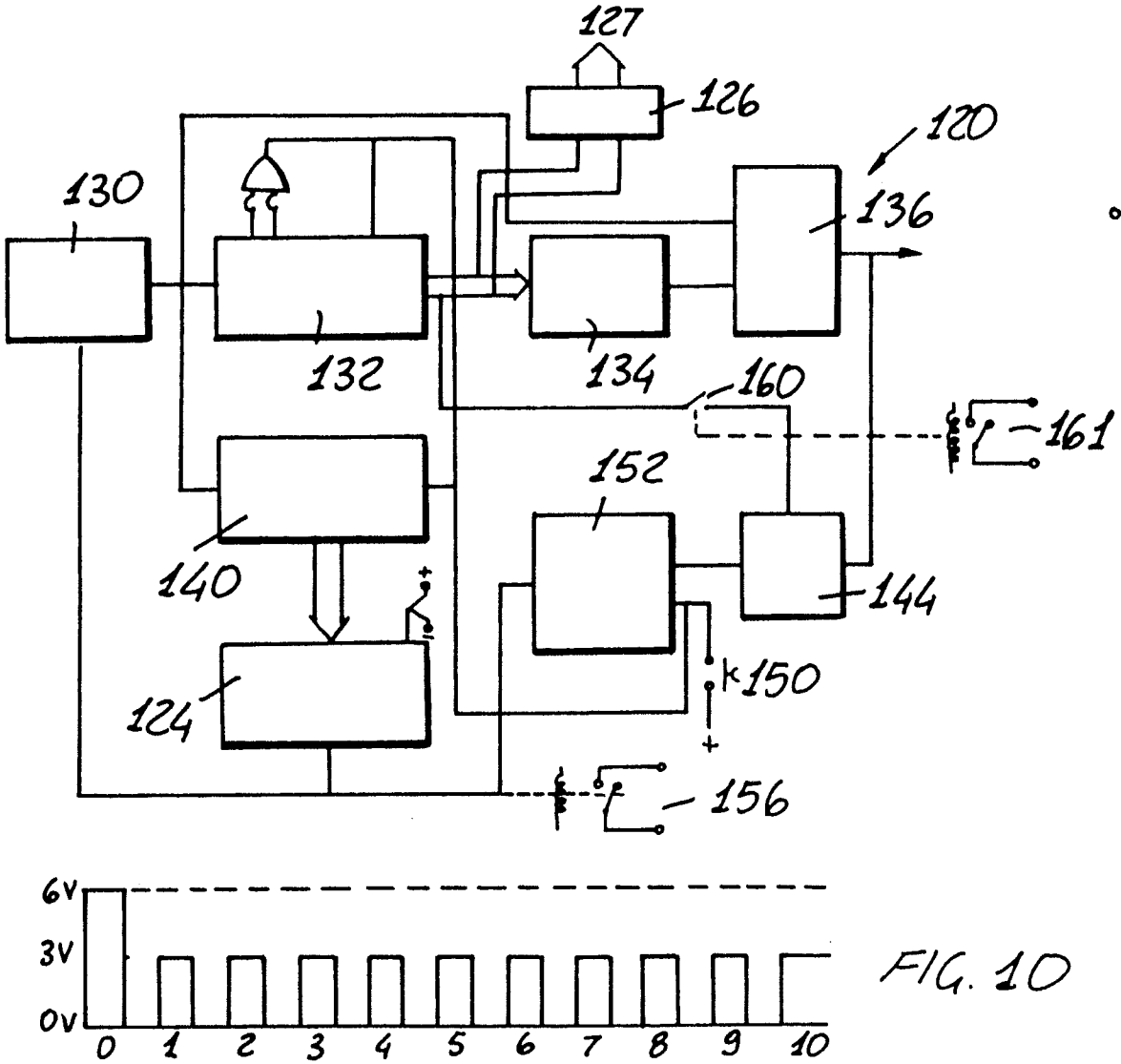
FIG. 10 illustrates a further block diagram of the central control card, according to a preferred embodiment thereof.

The central control card 120, as it is clearly shown in FIG. 10, comprises an oscillator 130, which generates a signal having a frequency of 10/20 KHz, and sends i t to a binary counter 132, programmable for 64, 128, 192, 256 pulses in order to fit the knitting machines having a different number of yarn feeders.

The first pulse is used for performing a zeroing operation, and accordingly 63,127, 191 , 255 pulses will be respectively available.

The unit 134 provides a or clearing signal, having a voltage from 0 to 6 volt, and will send these signals to a buffer 136 which will amplitude modulate the signals.

Through the buffer 136 further pass the signals sent by a decimal counter 140.

By means of the absorbing detector 144, as a coding card passes to an alarm condition, because of an operation of a switch, then a great current drain occurs and then the unit 152 will cause the textile machine to stop its operation through the relay 156, will switch on the display 124 and lock the oscillator 130 and counters 132 and 140. The display, as stated, is a three digit display, and it displays the precise number of the yarn feeder where the alarm has been energized, and, moreover, it will also signal if the switch is high or low, that is related to the levers 20 or 50.

A reset pushbutton 150 is moreover provided, which is connected to an unit 152 which will start again, after a locking, the counting system.

A switch 160 actuates a relay 161, which allows the low switches to be inhibited, that is the levers 50.

In this case the textile machine can operate exclusively by pulses.

Figure 9:
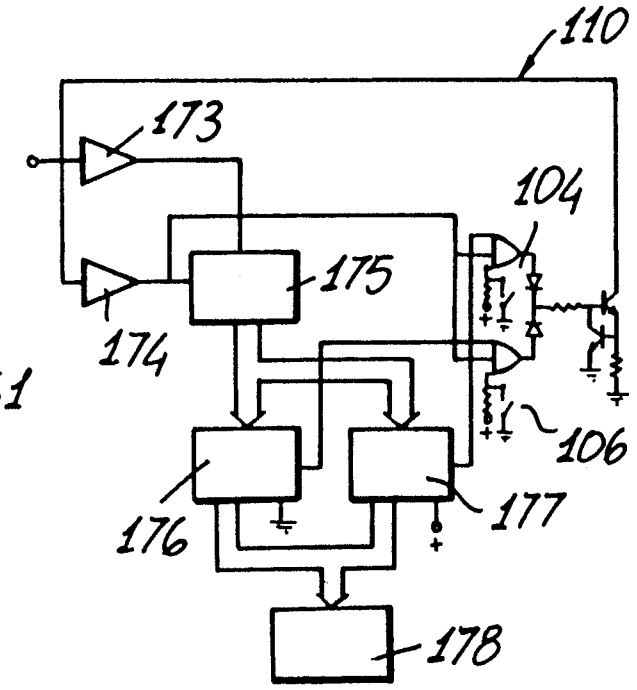
FIG. 9 illustrates a block diagram of a preferred, though not limitative, embodiment of the coding card or board.

Each coding card, as is clearly shown in FIG. 9 has an input for the signals or pulses coming from the central control card 120, which signals are supplied to an analogic comparator 173 which will detect the "high" signal (6 V) and will clear the counter 175.

The second analogic comparator 174 will detect the "low" (3 V) signals and will enable the counter 175 counting operation.

The counter 175 will send its output pulses to the digital comparator 176, which controls the switch 106, and to the comparator 177, which control the switch 104, said comparators being connected to a dipswitch 178, to each individual coding card corresponding a different number of the dipswitches.

By way of example, if the dipswitch is set on the number 10, in order to better understand the operation of a coding card, then the counter will start to count.

At the first pulse, the digital comparator (176/177) will receive "1" from the counter 175 and from the dipswitch 178; at the second pulse it will have "2", on a side, and 10, on the other, and so on until it will have 10 on both sides.

Now, the coding card self-recognizes itself and will control if one of the switches 104 or 106 has been energized.

If not, then the counting operation continues.

If, on the contrary, a switch has been actuated, then a comparatively high amplitude signal is generated, which will increase the current drain to about 10/15 mA, and is sent in the same time in which the count was 10, and on the same line of the 3 volt pulses, thereby the alarm is energized.

In order to prevent false al arms from occurring, due, as stated, to momentary vibrations of the yarn, the control card is programmed so as to delay by few milliseconds the actual stopping of the textile machine, so as to overcome, without any stop, several possible transitory faults which do not affect the evenness of the product.

Exclusively if the anomalous tension condition of the yarn continues beyond the set ti me, then the textile machine will be stopped and the related display will be provided on the display device.

It is moreover provided a built-in autodiagnosis system of the control card, so that, if a fault occurs in said control card, then this will be signalled and the textile machine stopped.

Finally, it is provided that the control card, through the interface, can communicate to a computer; the number of occurred interruptions on each switch, so as to provide useful diagnostic data in order to aid the operator to detect the causes of the single repetitive faults, at a given region of the textile machine.

From the above disclosure it should be apparent that the invention fully achieves the intended aim and objects.

In particular the fact is to be pointed out that an electronic device has been provided allows an operator to easily and quickly detect a possible fault yarn feeder.

The invention, as disclosed, is susceptible to several modifications and variations all of which come within the spirit of the inventive idea.

Moreover, all of the details can be replaced by other technically equivalent elements.

In practicing the invention, the used materials, as well as the contingent size and shape can be any according to requirements.

I claim:

1. An improved feeder apparatus for automatically controlling in real time a tension of a textile yarn being supplied to textile machines, comprising a lever device for continuously controlling said tension of said yarn and a display and control device for displaying and controlling faults of said feeder apparatus, lever device engaging swinging lever means arranged downstream of a drum and operating for controlling the position of adjustable movable shield means for intercepting light arranged between a photoemitting element and a photosensor element, for transforming radiation impinging thereon into an electronic signal controlling said display and control device, said lever means being urged so as to adhere to said yarn by arm means connected to said lever means and arranged on a side opposite to articulation fulcrum means of said lever means; said shield means including a sheet element applied to said arm means and laying in a plane substantially parallel to said lever means, wherein said display control device comprises codifying card means controlling switch means and coupled by two coupling wires to central control card means adapted to detect an actuated switch of said switch means to drive display means for displaying an affected feeder and stop said textile machine.

2. An improved differ apparatus according to claim 1, wherein said codifying card means are connected to said central control card means by a line including two wires one of which is provided for supplying with a direct current and with a to-ground return said card means, and the other wire of said line providing a connection line for detecting by said central control card means, a switching condition of said switch means.

3. An improved feeder apparatus, according to claim 1, wherein said codifying card means are adapted to detect and differentiate signals coming from said switch means.

4. An improved feeder apparatus, according to claim 1, wherein said codifying card means comprise at least an analogic comparator and a digital comparator, a 8-bit counter and a dipswitch to identify feeder means.

5. An improved feeder apparatus, according to claim 1, wherein said central control card means comprise an oscillator, two counters, one of which is programmable in 64, 128, 192, 246 pulses, two comparators, an absorption detector and a multiple digit display.

6. An improved feeder apparatus, according to claim 1, wherein said central control card means are interconnected, through interface means, to computer means.

7. An improved feeder apparatus, according to claim 1, wherein said codifying card means are controlled by first cable means including at least two wires and coupled to said central control card means.

8. An improved feeder apparatus, according to claim 1, wherein said codifying card means are controlled by second two-wire cable means connected to said central control card means.

9. An improved feeder apparatus according to claim 7, wherein at least one of said wires is a connection wire for allowing said central card means to detect a switching condition of said switch means.

10. An improved feeder apparatus according to claim 8, wherein said second two-wire cable means controlling said codifying card means are used to supply said codifying card means and stop said textile machine, by said switch means.

11. AN improved feeder apparatus according to claim 4, wherein said codifying card means are arranged inside said feeder means.

12. An improved feeder apparatus according to claim 1, wherein said central control card means comprise a microprocessor driving said display and control device on said computer means and means for stopping said textile machine.

* * * * *